United States Patent [19]

Gunter

[11] Patent Number: 4,768,262

[45] Date of Patent: Sep. 6, 1988

[54] APPARATUS AND METHOD FOR TEXTILE STRAND DRAFTING

[75] Inventor: Josef K. Gunter, Durham, N.C.

[73] Assignee: Industrial Innovators, Inc., Durham, N.C.

[21] Appl. No.: 33,116

[22] Filed: Mar. 31, 1987

[51] Int. Cl.[4] ..... D01H 5/74

[52] U.S. Cl. ..... 19/258; 19/97; 19/106 R; 19/266; 19/286

[58] Field of Search ..... 19/258, 266, 278, 286, 19/106 R

[56] References Cited

U.S. PATENT DOCUMENTS

| | | | |
|---|---|---|---|
| 12,040 | 12/1854 | Taylor . | |
| 1,433,529 | 10/1922 | Butler | 19/286 |
| 1,722,141 | 7/1929 | Grivel . | |
| 2,244,461 | 6/1941 | Kettley . | |
| 2,710,428 | 6/1955 | Nutter et al. . | |
| 2,759,520 | 8/1956 | Lawrence . | |
| 2,773,297 | 12/1956 | Cotchett . | |
| 3,078,519 | 2/1963 | Angioletti | 19/258 |
| 4,301,573 | 11/1981 | Gunter et al. | 19/200 |
| 4,489,461 | 12/1985 | Hasegawa et al. | 19/258 |
| 4,539,729 | 9/1985 | Meile et al. | 19/288 |
| 4,551,887 | 11/1985 | Uematsu | 19/244 |

FOREIGN PATENT DOCUMENTS

| | | | |
|---|---|---|---|
| 0736957 | 9/1955 | United Kingdom | 19/266 |

*Primary Examiner*—Louis K. Rimrodt
*Attorney, Agent, or Firm*—Richard E. Jenkins

[57] ABSTRACT

A novel fiber drafting system disclosed according to which a textile fiber strand is passed through a plurality of pairs of drafting rollers wherein one of each pair of drafting rollers includes a circumferential groove for receiving the fiber strand and the other roller includes a circumferential rib for compressing the strand in the recessed groove to a cross-sectional shape substantially conforming to the groove. The plurality of pairs of rib and groove rollers are rotated such that each successive pair along the drafting pathway of the textile fiber strand has a greater circumferential speed than the preceeding pair of drafting rollers. In this fashion a textile fiber strand is compressed into a cross-section configuration which substantially equalizes the pressure on all fibers being drafted and thereby provides a more uniformly drafted strand.

17 Claims, 6 Drawing Sheets

APPARATUS AND METHOD FOR TEXTILE STRAND DRAFTING

DESCRIPTION

TECHNICAL FIELD

The present invention relates generally to a textile fiber strand drafting system. More specifically, it relates to the provision of a novel apparatus and method for drafting textile fiber strands which utilizes a plurality of pairs of tongue and groove type drafting rollers to produce a drafted textile fiber strand possessing improved uniformity.

BACKGROUND ART

The drafting of textile fiber strands of sliver, roving or the like by means of a plurality of pairs of upper and lower rollers has long been known. The pairs of rollers are typically arranged along the textile fiber strand pathway such that the peripheral speed of each pair of successive rollers is greater than the preceding pair of drafting rollers. However, the conventional drafting rollers suffer a fundamental shortcoming in that they tend to flatten the textile fiber strand in the nip between the drafting rollers during the drafting process. As the textile fiber strand is flattened, it tends to assume a relatively wider, ribbon-like shape which results in the opposing side or selvedge fibers being attenuated more than the fibers in the medial portion of the textile fiber strand. This, of course, introduces a certain amount of undesirable non-uniformity in the resulting drafted fiber strand which is produced by the drafting apparatus.

It has been found that, as the textile fiber strand is compressed between a pair of drafting rollers into the ribbon-like configuration, the fibers in the medial portion of the strand are subjected to a greater relative pressure than those on the opposing edges or selvedges of the strand. The variation in pressure to which the fibers are subjected at the nip of each pair of drafting rollers introduces non-uniformities into the resulting drafted strand since the fibers in the selvedges of the strand tend to be released from the nip of each pair of drafting rollers prior to the fibers in the medial portion of the flattened ribbon-like strand. Therefore, the need for a drafting apparatus utilizing a plurality of pairs of drafting rollers which are able to exert a more uniform pressure on the fibers in the textile fiber strand during the drafting process so as to result in a more uniform drafted strand has long been recognized in the textile art.

To date, the value of the use of a tongue and groove type roller assembly for compressing a textile fiber strand prior to feeding it to drafting rollers has been appreciated. U.S. Pat. No. 4,551,887 to Murata discloses a draft roll assembly for use with a pneumatic high speed spinning frame which comprises one or more pairs of tongue and groove compression rollers to receive a sliver strand and compress it prior to the sliver strand being fed to conventional draw rollers. The tongue and groove rollers are intended to compress the sliver strand while containing its width-wise expansion so that its density will be increased at drafting in order to impart improved drafting efficiency and higher quality yarn spun from the drafted strand. Of particular note, lines 23–46 of column 2 teaches that while it is possible to arrange a plurality of pairs of tongue and groove compressing rollers upstream of the drafting rollers, any drafting phenomenon is undesirable and is to be avoided.

U.S. Pat. No. 4,489,461 to Toyoda also discloses a drafting system for drafting textile sliver prior to the fiber being spun into yarn. The drafting system utilizes a first pair of tongue and groove rollers to compact the sliver into a reduced cross section therebetween and a subsequent pair of conventional drafting rollers rotating at a much higher peripheral speed than the tongue and groove rollers. In this fashion, the drafting system is able to obviate the necessity for utilizing conventional drafting aprons to transfer the fiber strand from one pair of drafting rollers to the next pair. Also of interest, U.S. Pat. No. 4,539,729 to Rieter discloses a tongue and groove roller pair for the continuous compression of a fiber sliver wherein the sliver feed funnel is positioned within a wedge-shaped gap which is bounded by the overlapping zone of the side surfaces of the interacting rollers.

However, applicant does not believe that the benefits of continuously drafting a sliver strand in a condensed and uniform configuration between a plurality of pairs of tongue and groove type drafting rollers in order to improve the distribution of forces on the individual fibers within the strand and therefore the resulting uniformity of the drafted fiber strand has been appreciated in the art to this date.

DISCLOSURE OF THE INVENTION

In accordance with the present invention, applicant provides a new and improved apparatus and method for the continuous drafting of a textile sliver strand which utilizes a plurality of pairs of drafting rollers wherein each pair comprises a drafting roller having a circumferential recessed groove for receiving the fiber strand therein and the other drafting roller has a circumferential rib adapted to compress the strand in the recessed groove into a cross-sectional shape conforming to the general shape of the groove. In this fashion, the individual fibers within the fiber strand are subjected to a relatively uniform pressure at the nip of each pair of drafting rollers within the drafting assembly in order to assure that the drafted textile strand has better uniformity than has heretofore been achievable during the drafting process. Although the apparatus of the invention lends itself to many applications in textile manufacturing, it is particularly well suited for use at the delivery end of a textile card in order to provide a high level of uniformity to a drafted textile fiber strand which is intended to be taken from the carding process directly to open end spinning. It is to be emphasized, however, that many other applications for the novel drafting apparatus and method of the present invention are contemplated wherein a highly uniform drafted textile fiber strand is desired.

Therefore, it is a primary object of the present invention to provide a drafting system for a textile fiber strand which imparts a high degree of uniformity to the strand during the drafting process.

Another object of the present invention is to provide for the drafting of a textile fiber strand having a high degree of uniformity by the use of a simple and inexpensive apparatus.

Still another object of the present invention is to provide an apparatus and method for the drafting of a textile fiber strand wherein the fiber strand is not compressed into a flat, ribbon-like configuration during the drafting process but rather is placed into a relatively narrow and high density rectangular cross-sectional configuration in order to assure relatively equal pressure on all fibers within the strand.

Some of the objects of the invention having been stated, other objects will become evident as the description proceeds, when taken in connection with accompanying drawings.

BEST MODE FOR CARRYING OUT THE INVENTION

Figure 1:
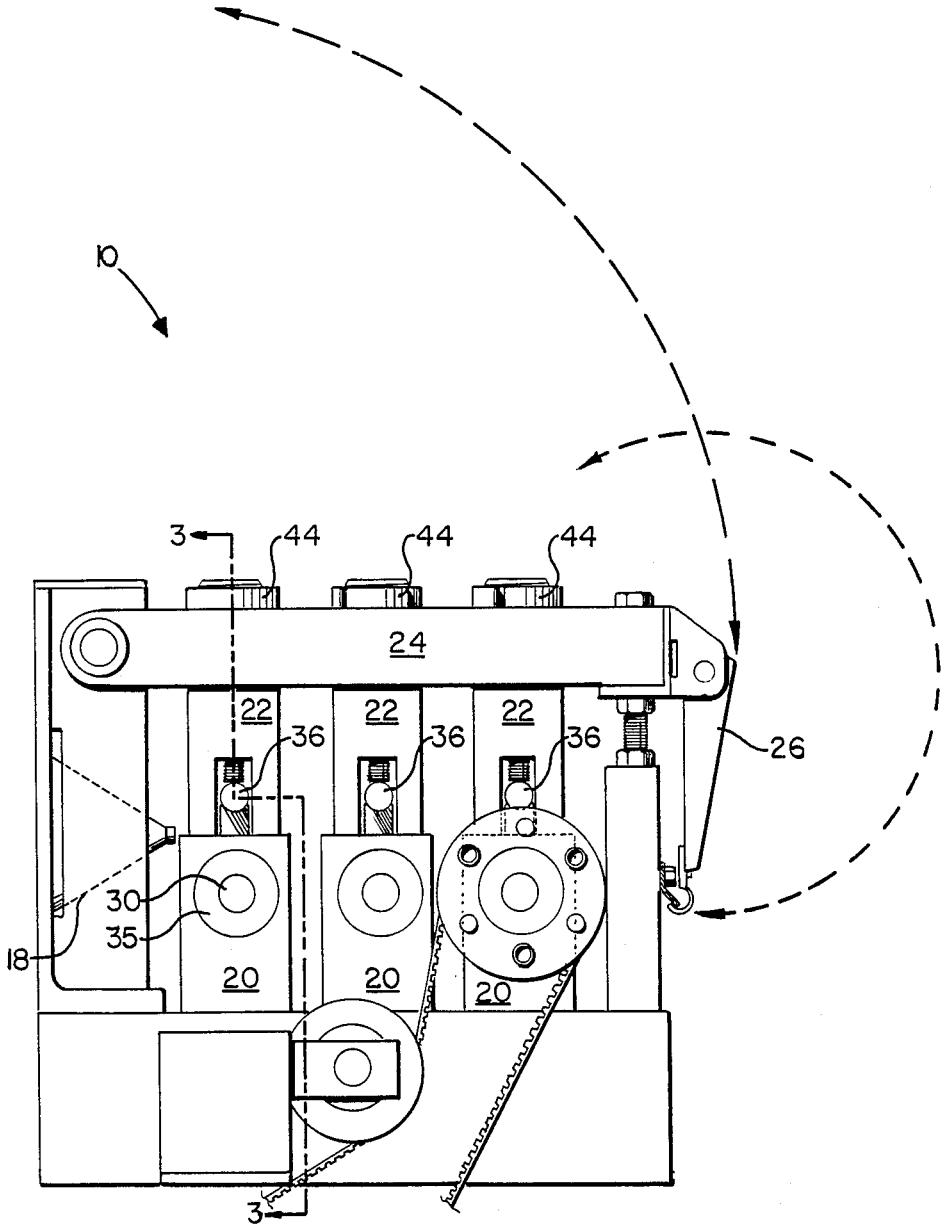
FIG. 1 is a side elevation view of a preferred embodiment of a drafting apparatus constructed according to the present invention.
Figure 2:
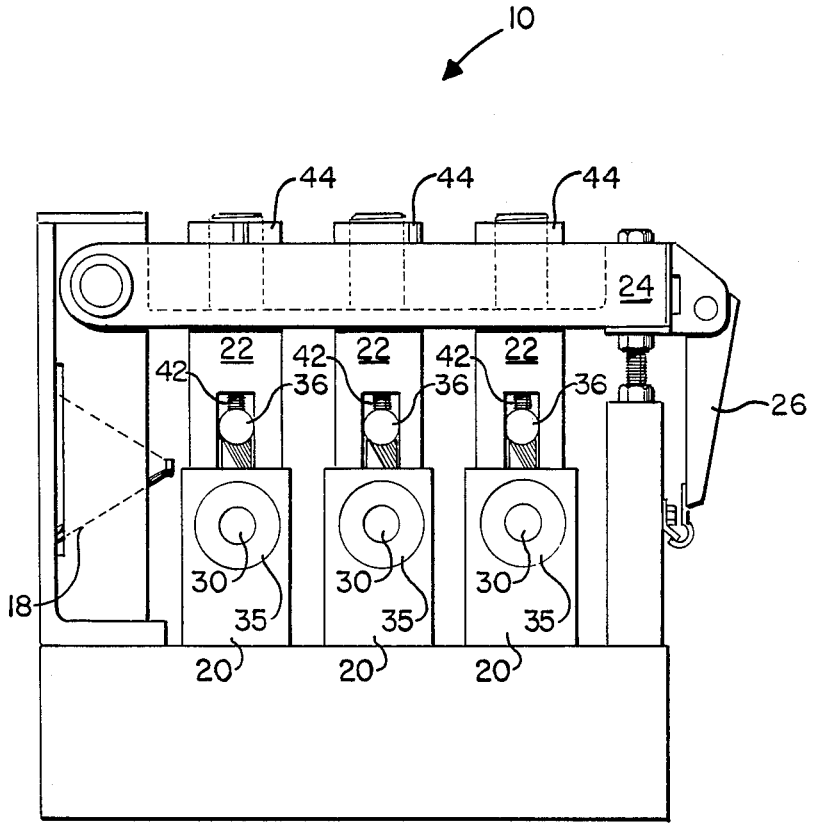
FIG. 2 is a side elevation view of the drafting apparatus of FIG. 1 with parts removed for clarity.

Referring now more specifically to the drawings, FIGS. 1–5 illustrate the exemplary embodiment of the apparatus of the instant invention for drafting textile fiber strands in such a fashion as to result in improved uniformity. The drafting apparatus, generally designated 10, includes in the exemplary embodiment three pairs of drafting rollers including back rollers 12, middle rollers 14, and front rollers 16. Each of the pairs of drafting rollers 12, 14 and 16 includes both an upper roller and a lower roller which are in operative engagement each with the other. For example, drafting roller pair 12 includes upper roller **12*a* and lower roller 12*b*, drafting roller pair 14 includes upper roller 14*a* and lower roller 14*b*, and drafting roller pair 16 includes upper roller 16*a* and lower roller 16*b*. Each of the pairs of drafting rollers 12, 14 and 16 includes a drafting roller defining a circumferential recessed groove in the medial portion thereof and a drafting roller defining a circumferential rib located in the medial portion thereof (see FIGS. 3 and 4). Each pair of drafting rollers is arranged so that the circumferential rib of one roll cooperates with the circumferential groove of the other roll of the pair so as to define a space in the nip therebetween which has a cross-sectional shape substantially conforming to that of the groove. The space defined between each pair of cooperating drafting rollers can be seen in FIG. 3 where it is defined by drafting rollers 12*a*, 12*b* and designated A for clarity of understanding. As can also be seen with particular reference to FIGS. 4 and 5, drafting roll pairs 12, 14 and 16 consist of upper rollers 12A, 14A and 16A which alternate between drafting rollers with circumferential ribs and drafting rollers with circumferential grooves, and bottom rollers 12B, 14B and 16B which also consist of alternating circumferential rib and circumferential groove rollers. This allows for positioning drafting roller pairs 12, 14 and 16** closer together than otherwise would be possible in order to provide for a short nip distance therebetween which betters serves to eliminate thick and thin spots in a textile fiber strand being drafted.

As will be apparent to those skilled in the textile fiber drafting art, as a textile fiber strand passes between each of drafting roll pairs 12, 14 and 16 it is compressed between space A at each pair of rollers into a dense and relatively uniform configuration which results in a more uniform pressure being exerted on individual fibers within the textile fiber strand being compressed therebetween. Whereas conventional drafting rollers tend to flatten the textile fiber strand into a ribbon-like cross-sectional configuration and thereby widen the strand so that the fibers on the opposing sides thereof are subjected to different pressure than the fibers in the medial portion of the flattened strand, the compaction of the strand into a relatively narrow textile fiber strand of a substantially uniform height provides for relatively equal pressure on all fibers during the drafting process. The drafting of the textile fiber strand in a non-flat configuration has been shown to result in significantly improved uniformity of the resulting drafted strand over that which could be achieved by conventional drafting rollers.

Drafting apparatus 10 further includes a trumpet 18 into which a sliver web is fed and condensed into a textile fiber strand which is then introduced to the first pair of drafting rollers 12. As can also be seen with particular reference to FIGS. 1 and 5, drafting apparatus 10 is constructed so that it may be pivotably opened as may be necessary for access to fiber strand S and in order to make certain operating adjustments which will be discussed hereinafter. Lower drafting rollers **12*b*, 14*b*, 16*b* are all secured to lower vertical support blocks 20 which are in turn secured to the frame of drafting apparatus 10 in such a fashion as not to allow for vertical movement. Upper drafting rollers 12*a*, 14*a*, 16*a* are secured to upper vertical mounting blocks 22 which are adjustably secured to support arms 24. Support arms 24 are pivotably mounted to the back frame of drafting apparatus 10 so that when latches 26 (see FIG. 1) are unlocked, support arms 24 along with upper vertical mounting blocks 22 and upper drafting rollers 12*a*, 14*a*, 16*a* can be pivotably raised in order to open drafting apparatus 10** for inspection or maintenance as may be necessary.

Figure 3:
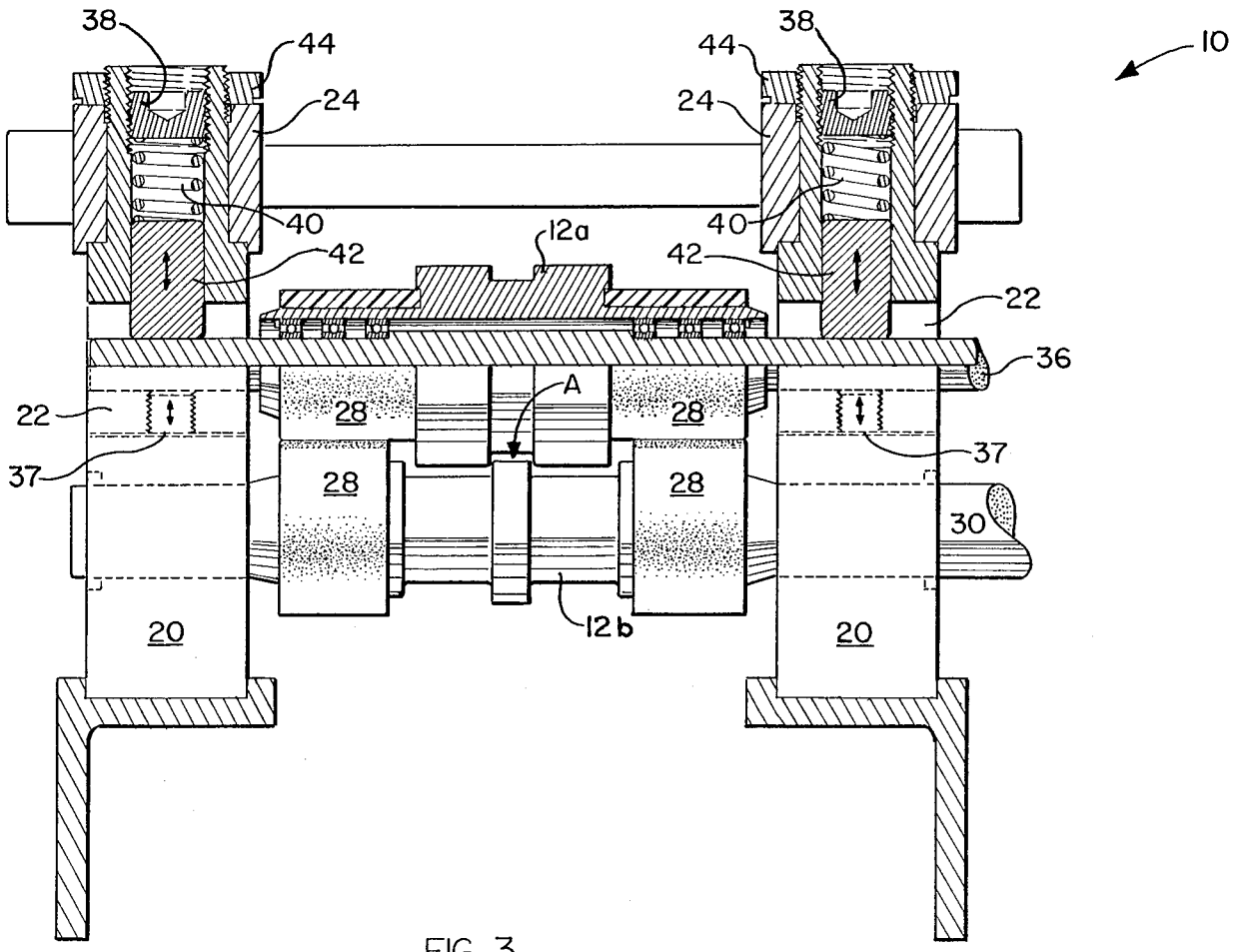
FIG. 3 is a vertical cross-sectional view as seen from lines 3—3 in FIG. 1.
Figure 4:
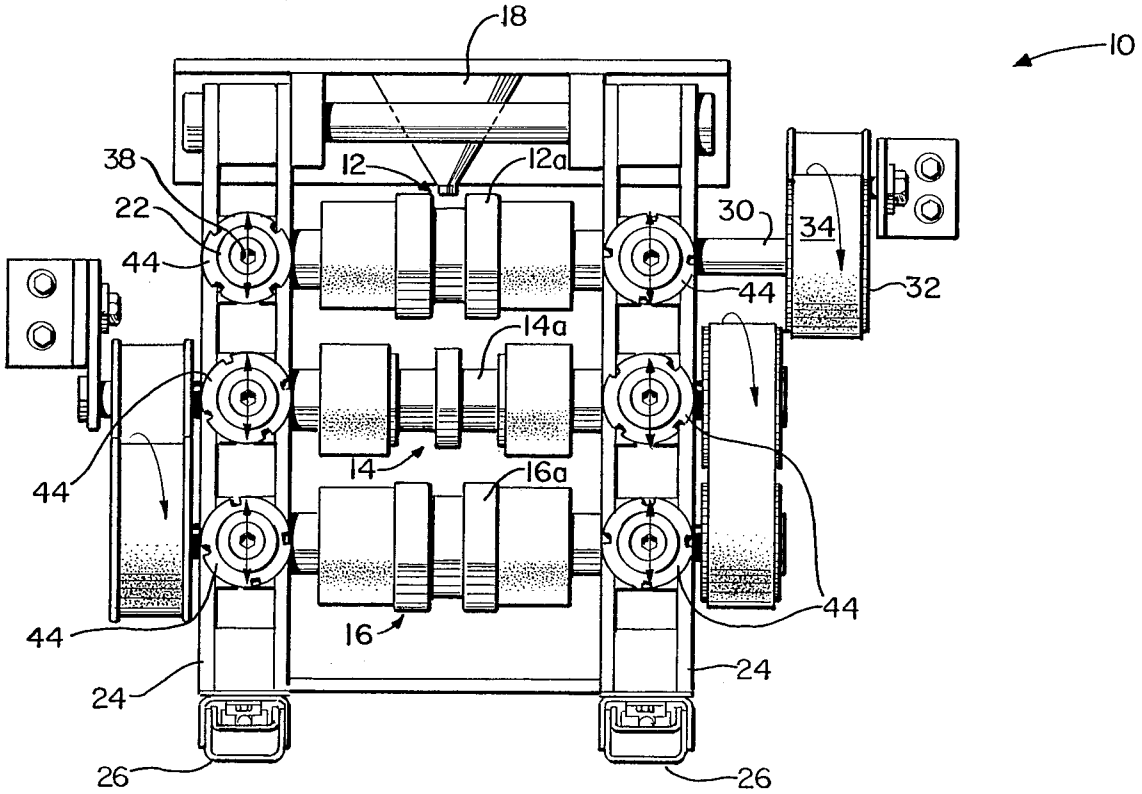
FIG. 4 is a top plan view of the drafting apparatus of FIG. 1.
Figure 5:
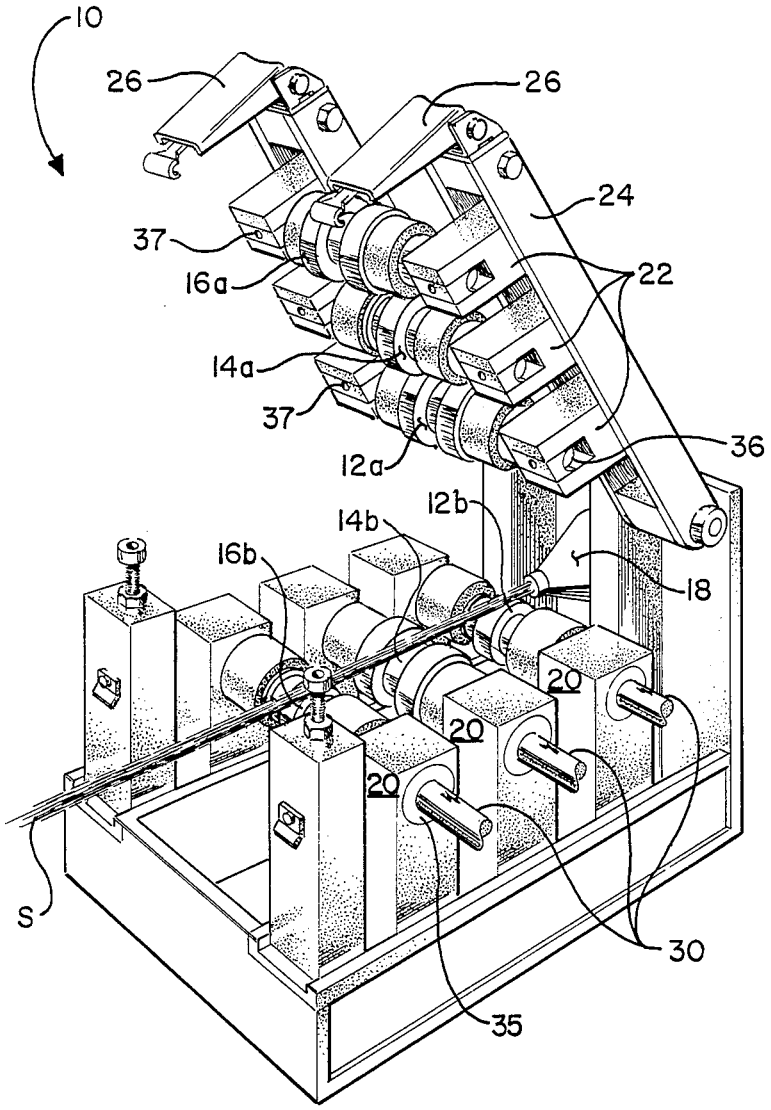
FIG. 5 is a perspective view of the drafting apparatus of FIG. 1 with parts removed for clarity.
Figure 6:
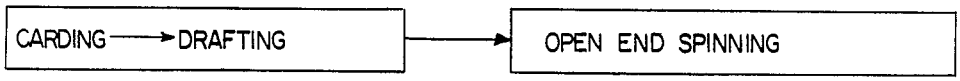
FIG. 6 is a schematic drawing illustrating textile fiber and strand processing.

With reference now to FIGS. 3 and 4, the specific structure of the drafting rollers will be discussed along with the adjusting mechanisms therefore which are included in drafting apparatus 10 described herein. With specific reference to FIG. 3, upper drafting roller **12*a* and lower drafting roller 12*b* can be seen to include a cot surface 28 at each end thereof. This cot surface is preferably rubber having about a 50 Durometer hardness. Drive shaft 30 to which lower drafting roller 12*b* is mounted is driven by pulley 32 and belt 34 (see FIG. 4) and is rotatably mounted at each end thereof in bearings 35 (see FIG. 2). Moreover, lower draft rollers 14*b* and 16*b* are also directly driven in a similar fashion known to those familiar with the drafting art. Lower drafting roller 12*b* (see FIG. 3) therefore drives upper drafting roller 12*a* due to the frictional contact between cot surfaces 28 located at opposing ends of each drafting roller. Upper drafting roller 12*a* is rotatably mounted on fixed upper shaft 36. A critical adjustment to drafting apparatus 10, the space A defined between upper drafting roller 12*a* and lower drafting roller 12*b*, can be determined by set screws 37 which are located in the bottom face of upper vertical mounting blocks 22. It should be appreciated that a corresponding pair of set screws 37 are also provided for the remaining two pairs of upper vertical mounting blocks 22. By adjusting set screws 37 it is possible to raise or lower the height of space A by increasing or decreasing the space between the shafts of each pair the rollers. Although the width of a textile fiber strand confined within the groove of upper drafting roller 12***a* will be substantially constant, the height may be varied by proper adjustment of set screws 37. The purpose of this adjustment is to prevent the rollers from touching when not processing fiber and to remain sufficiently close for threading up.

A second adjustment to drafting apparatus 10 is provided by tension set screws 38 which may be raised or lowered within upper vertical mounting blocks 22 in order to adjust the resilient force applied by springs 40 on vertically shiftable tension elements 42 which are urged against shaft 36 around which upper drafting roller 12*a* rotates. By adjusting tension set screws 38 downwardly within upper vertical support blocks 22 the associated tension elements 42 will be resiliently urged against shaft 36 with greater force. In this fashion, it will require a greater force to raise upper drafting roller 12*a* relative to vertically fixed lower drafting roller 12*b*. A corresponding pair of tension set screws 38 are also provided for the remaining two pairs of upper vertical mounting blocks 22.

With particular reference at this time to FIG. 4, the third adjustment of drafting apparatus 10 can be described. Spanner nuts 44 are provided at the top of each upper vertical mounting block 22 and are adapted to threadably engage the external threads provided adjacent the top thereof. In this fashion, spanner nuts 44 may be unscrewed to easily loosen the normally tight engagement of vertical mounting blocks 22 with upper support arms 24 (see FIG. 3), and upper vertical mounting blocks 22 may then be slidably adjusted relative to each other in order to properly position the associated upper drafting rollers 12*a*, 14*a*, 16*a*. Then, spanner nuts 44 are again tightened so that they engage upper support arms 24 with substantial friction as to be fixedly secured thereto.

Therefore, as described hereinbefore, it is possible to adjust the space A defined between each pair of drafting rollers of drafting apparatus 10, the downward force applied to upper drafting rollers 12*a*, 14*a*, 16*a*, and the lateral distance between each of upper drafting rollers 12*a*, 14*a*, 16*a*.

In operation, textile fiber strand S is fed through trumpet 18 into the first pair of drafting rollers 12. From there the strand travels to the second pair of drafting rollers 14 and the third pair of drafting rollers 16 from which the highly uniform drafted strand is then collected in a manner well known in the textile field. The pairs of drafting rollers 12, 14 and 16 each comprise a roller having a circumferential recessed groove and a cooperating roller having a circumferential rib in order to define space A at the nip therebetween substantially having the same cross section as the groove. Each successive pair of drafting rollers 12, 14, and 16 is rotated at a circumferential speed greater than the preceding pair in order to draft the textile strands in the first drafting zone between drafting roller pairs 12 and 14 and the second drafting zone between drafting roller pairs 14 and 16. Space A defined between the rib and groove of each cooperating pair of drafting rollers serves to confine textile strands while therebetween to a highly compressed, substantially rectangular cross-sectional configuration wherein the pressure on the fibers within the strands is relatively uniform. This has been found to result in enhanced uniformity over prior art drafting apparatus utilizing conventional drafting rollers which tend to compress the textile fiber strand into a flattened and widened configuration with the opposing edges or selvedges containing fibers which are not held as well as those in the medial portion of the strand. This tends to introduce irregularities into strand S. As noted previously, fully drafted strand S is collected in a conventional manner which may typically be a delivery can or the like from which the sliver strand will be taken to a spinning machine.

The drafting system of the present invention has a preferred draft range of about 1.4 to 5.0 with about 68 percent to 70 percent of the total draft occurring in the first zone between the first pair of drafting rollers 12 and the second pair of drafting rollers 14, and the remaining 30 percent of the draft occurring in the second draft zone between the second pair of drafting rollers 14 and the third pair of drafting rollers 16. It has been found that an acceptable parallelization of fibers occurs in strand S with a draft of about 1.8 if the drafted strand comprises synthetic fibers (such a polyester, acrylics, or nylon) and is intended to be fed directly to an open end spinning machine. As described hereinbefore, fiber strand compaction space A may be adjusted with set screws 37, the spring pressure on each top roller may be adjusted with tension set screws 38, and the distance between top drafting rollers 12*a*, 14*a*, 16*a* can be adjusted by spanner nuts 44.

It will thus be seen that there has been described above an improved drafting apparatus and method for a textile fiber strand which utilizes a plurality of pairs of rib and groove or tongue and groove drafting rollers to achieve the high level of uniformity in the drafted strand.

It will be understood that various details of the invention may be changed without departing from the scope of the invention. Furthermore, the foregoing description is for the purpose of illustration only, and not for the purpose of limitation--the invention being defined by the claims.

What is claimed is:

1. An improved apparatus for drafting a textile fiber strand wherein said fiber strand is compacted into a relatively narrow fiber strand of substantially uniform height by the drafting apparatus, comprising:

at least two pairs of top and bottom drafting rollers for drafting the fiber strand during its passage along a drafting pathway through said drafting apparatus, wherein one roller of each pair of drafting rollers comprises a circumferential recessed groove therearound for receiving the fiber strand and the other roller of each pair of drafting rollers comprises a circumferential rib therearound adapted to mesh and compress the strand in said recess and wherein said at least two pairs of drafting rollers are each arranged with an upper and lower drafting roller, said upper drafting rollers at least once alternately comprising a drafting roller with a circumferential recessed groove and a drafting roller with a circumferential rib;

means for urging at least one of said at least two pairs of drafting rollers into operative engagement; and means for rotating said pairs of drafting rollers such that each successive pair along the drafting pathway of the fiber strand has a greater circumferential speed than the preceeding pair of drafting rollers.

2. An apparatus for drafting according to claim 1 wherein said apparatus is connected to the delivery end of a textile card in order to provide a uniform fiber strand at the delivery end of the textile card for subsequent use in open end spinning and the like.

3. An apparatus for drafting according to claim 1 wherein said upper drafting rollers alternately comprise a drafting roller with a circumferential recessed groove and a drafting roller with a circumferential rib.

4. An apparatus for drafting according to claim 3 wherein said plurality of pairs of drafting rollers comprises three pairs.

5. An apparatus for drafting according to claim 4 wherein the upper roller of the first pair of drafting rollers along the drafting pathway of said plurality of pairs of drafting rollers comprises a recessed groove roller.

6. An apparatus for drafting according to claim 1 wherein at least one roller within each pair of said drafting rollers includes an elastomeric cot-like surface provided around the circumferential surface thereof adjacent at least one end, said cot-like surface of said at least one drafting roller within each pair of drafting rollers being in frictional contact with the surface of the other drafting roller within said pair of drafting rollers.

7. An apparatus for drafting according to claim 6 wherein said cot-like surface is provided adjacent both ends of said drafting rollers and comprises rubber.

8. An apparatus for drafting according to claim 1 wherein each pair of drafting rollers define a generally rectangular space therebetween for receiving the textile strand when said pair of drafting rollers are in operative engagement.

9. An apparatus for drafting according to claim 1 wherein said means for urging resiliently urges each of said pairs of drafting rollers into operative engagement.

10. An apparatus for drafting according to claim 9 wherein said means for urging comprises spring means for urging one of said pair of drafting rollers into operative engagement with the other of said pair of drafting rollers.

11. An apparatus for drafting according to claim 1 wherein said means for rotating said pairs of drafting rollers provides a total draft of about 1.4–5.0.

12. An apparatus for drafting according to claim 11 wherein said means for rotating drives one drafting roller within each pair of drafting rollers.

13. An improved method of drafting a textile fiber strand wherein said fiber strand is compacted into a relatively narrow fiber strand of substantially uniform height by the drafting process, the method comprising:

feeding the fiber strand to at least two pairs of top and bottom drafting rollers for drafting of the fiber strand during its passage along a drafting pathway through said at least two pairs of drafting rollers wherein one roller of each pair of drafting rollers comprises a circumferential recessed groove therearound for receiving the silver strand and the other roller of each pair of drafting rollers comprises a circumferential rib therearound adapted to mesh and compress the strand in said recess and wherein said at least two pairs of drafting rollers are each arranged with an upper and lower drafting roller, said upper drafting rollers at least once alternately comprising a drafting roller with a circumferential recessed groove and a drafting roller with a circumferential rib;

urging at least one of said at least two pairs of drafting rollers into operative engagement;

rotating each of said pairs of drafting rollers at a circumferential speed which is greater than the circumferential speed of the preceeding pair of drafting rollers along the fiber strand drafting pathway; and drafting the fiber strand between successive pairs of said at least two pairs of drafting rollers along the fiber strand drafting pathway.

14. A method of drafting a textile fiber strand according to claim 13 wherein said fiber strand is compressed between each pair of drafting rollers into a substantially rectangular cross section wherein the width of the fiber strand is contained within the rectangular space defined between each of said pairs of rollers.

15. A method of drafting a textile fiber strand according to claim 13 wherein said drafting is performed such that the fiber strand is subjected to a total drift by said at least two pairs of drafting rollers of about 1.4–5.0.

16. A method of drafting a textile fiber strand according to claim 13 wherein said drafting is accomplished with three pairs of drafting rollers.

17. A method of drafting a textile fiber strand according to claim 13 wherein the drafting of the textile fiber strand occurs immediately subsequent to carding thereof in order to prepare a uniform textile strand for use in open end spinning and the like.

* * * * *